US008464997B2

(12) United States Patent
Peneder

(10) Patent No.: US 8,464,997 B2
(45) Date of Patent: Jun. 18, 2013

(54) FORMWORK ANCHOR

(75) Inventor: Johann Peneder, Ferschnitz (AT)

(73) Assignee: Doka Industrie GmbH, Amstetten (AT)

( * ) Notice: Subject to any disclaimer, the term of this patent is extended or adjusted under 35 U.S.C. 154(b) by 553 days.

(21) Appl. No.: 12/270,329

(22) Filed: Nov. 13, 2008

(65) Prior Publication Data

US 2009/0120031 A1 May 14, 2009

(30) Foreign Application Priority Data

Nov. 13, 2007 (DE) ..... 20 2007 015 833 U

(51) Int. Cl.
*E04G 17/06* (2006.01)

(52) U.S. Cl.
USPC ..... 249/213

(58) Field of Classification Search
USPC ..... 249/213–219.2, 190, 191, 40–46; 52/698–701, 704–711; 108/147.21; 248/188.4, 248/188.5, 616, 326, 333, 125.8; 411/393, 411/351; 403/109.1, 109.6, 378, 379.1–379.5
See application file for complete search history.

(56) References Cited

U.S. PATENT DOCUMENTS

| | | | | | |
|---|---|---|---|---|---|
| 1,137,998 | A | * | 5/1915 | Merriett | 249/191 |
| 2,074,460 | A | * | 3/1937 | Colt | 269/240 |
| 2,133,574 | A | | 10/1938 | Roemisch | |
| 2,135,745 | A | | 11/1938 | Cone | |
| 2,164,592 | A | * | 7/1939 | Pilj | 269/243 |
| 2,365,563 | A | * | 12/1944 | Krueper | 249/213 |
| 2,398,219 | A | | 4/1946 | Geer | |
| 2,486,683 | A | * | 11/1949 | Sass | 269/243 |
| 2,709,292 | A | * | 5/1955 | Otti | 249/43 |
| 3,013,323 | A | | 12/1961 | Williams | |
| 3,333,380 | A | * | 8/1967 | Wolf | 52/365 |
| 3,933,332 | A | * | 1/1976 | Lovisa et al. | 249/42 |
| 3,981,476 | A | * | 9/1976 | Alexander et al. | 249/42 |
| 4,159,097 | A | * | 6/1979 | Strickland | 249/40 |
| 4,216,933 | A | * | 8/1980 | Cramer, Jr. | 248/188.5 |
| 5,515,655 | A | * | 5/1996 | Hoffmann | 52/126.6 |
| 5,653,415 | A | * | 8/1997 | Schworer | 248/354.1 |
| 6,837,473 | B2 | * | 1/2005 | Petkau | 249/216 |
| 2006/0273481 | A1 | | 12/2006 | Peneder | |

FOREIGN PATENT DOCUMENTS

| | | |
|---|---|---|
| DE | 504741 | 8/1930 |
| DE | 8526281 U1 | 1/1987 |
| DE | 10336414 A1 | 3/2005 |

* cited by examiner

*Primary Examiner* — Janet M Wilkens
*Assistant Examiner* — Timothy M Ayres
(74) *Attorney, Agent, or Firm* — Fitch, Even, Tabin & Flannery LLP

(57) ABSTRACT

A formwork anchor for tight connection of formwork elements comprises a first anchoring portion which can be anchored on a first formwork element, an at least sectionally conical portion, and a second anchoring portion. The at least sectionally conical portion is provided between the first anchoring portion and the second anchoring portion, and an anchoring element provided to be positioned at the second anchoring portion in a certain anchoring position. The anchoring element can be displaced freely in relation to the second anchoring portion in the longitudinal direction thereof and can be fixed by means of engaging means in relation to the second anchoring portion in the longitudinal direction thereof.

13 Claims, 1 Drawing Sheet

FORMWORK ANCHOR

FIELD OF THE INVENTION

The invention relates to a formwork anchor for the tight connection of formwork elements in the field of reinforced concrete construction.

BACKGROUND

In the field of reinforced concrete construction, walls are produced, for example, by positioning two formwork elements so that their formwork surfaces are largely parallel to one another and anchoring them against one another by means of anchors which extend through the concrete which is later filled in. The distance between the opposing formwork elements, and thus the later wall thickness, is furthermore set by the anchors. The anchors must be removable from both the formwork elements that are anchored opposite to one another and from the hardened concrete. A so-called one-sided anchoring is provided in specific cases of use, in which the anchor can be essentially attached and removed on one side, the so-called anchor side, without work steps having to be carried out on the opposite side.

Known in this regard is a formwork anchor called a "Peri-Trio-Housing Anchor", which consists of an integral rod, the ends of which are threaded and the middle section of which is designed as a narrow cone. Owing to the thread at the one end, the anchor can be screwed into a nut which is fixed on a first formwork element that is provided on the opposite side. The conical section is located in the region of the area that is later filled with concrete and the cone makes it possible to remove the anchor in the direction of that side at which the cone has the larger diameter. A nut is screwed onto the thread provided at the other end, which acts together with a second formwork element provided on the anchor side and by means of which the desired wall thickness can be set.

In this regard, it has been shown that the application of the nut to the thread and thus the setting of the desired wall thickness is time-consuming. Moreover, the thread is prone to becoming dirty. Thus, the problem arises in particular that the thread is dirtied with concrete during concreting, and the anchor can only be adjusted to another wall thickness after extensive cleaning.

DESCRIPTION OF THE INVENTION

The object of the invention is to provide a formwork anchor a which is insusceptible to becoming dirty and enables quick setting of the wall thickness.

According to the invention, this object is solved by a formwork anchor for a tight connection of formwork elements of the present invention. Particularly preferred embodiments of the invention are stated below.

The invention is based on the idea to separate in a formwork anchor for a tight connection of formwork elements and positioning of the anchoring element on the second anchoring portion from the fixing of the anchoring element on the second anchoring portion. For this purpose, it is provided according to the invention that the anchoring element can be displaced freely in relation to the second anchoring portion in the longitudinal direction thereof and can be fixed by means of engagement means in relation to the second anchoring portion in the longitudinal direction thereof.

Thus, a thread in the area of the anchoring element and the second anchoring portion does not need to be provided so that the anchoring element can be displaced quickly and without difficulties onto the second anchoring portion and positioned. Also the removal of the anchoring element from the second anchoring portion can be carried out quickly, even with the common concrete adherences to these building elements. Furthermore, the formwork anchor according to the invention has a simple construction owing to the absence of threads in the area of the anchoring element and the second anchoring portion.

The engagement means can be configured in very different manners within the scope of the present invention. However, according to a further development of the invention, it is provided that the engagement means comprise at least one opening, in particular a through-hole in the second anchoring portion. Thus, a particularly safe and quick engagement is achieved with a simple construction.

The same advantages can be achieved as regards the anchoring element if according to a further development of the invention the engagement means comprise at least one opening, in particular a through-hole, in the anchoring element. In this regard, it is particularly preferred that the anchoring element has at least two openings which are arranged offset in the longitudinal direction of the second anchoring portion. This results in a more precise adjustability and fixability of the anchoring element in relation to the second anchoring portion, where the degree of precise adjustment can be further increased by turning the anchoring element and reverse mounting it onto the second anchoring portion.

In order to make this turning and reverse mounting of the anchoring element particularly easy, it is provided according to a further development of the invention that the anchoring element is of multipart design, with at least one part of the anchoring element being detachable from the other part(s) and being reconnectable in a deviating configuration. In this manner, as already mentioned above, the precise adjustment of the anchoring element in relation to the second anchoring portion is increased, with the anchoring element, basically unaffected by dirt, still being positioned and anchored in a quick, safe and precise manner.

With regard to this simple, safe and perfect fixing of the anchoring element in relation to the second anchoring portion, it is provided according to a further development of the invention that the engagement means have at least one arresting element which can be inserted into the at least one opening of the second anchoring portion and/or the anchoring element.

According to a further development of the invention, it is furthermore provided that the at least sectionally conical portion comprises several cones. Thus, it is achieved that, in particular with thin walls, an excessively large annular clearance is not formed between the formwork anchor and the formwork element, through which the formwork anchor is led. This results in less finishing effort on the manufactured wall as well as a reduced cleaning effort on the formwork anchor. Moreover, the formwork anchor can still be easily removed from the concrete.

According to a further development of the invention, it is furthermore provided that the second anchoring portion comprises markings, in particular a scale. Thus, the respective wall thickness can be adjusted in a particularly safe, quick and precise manner.

In order to be able to remove the formwork anchor safely and without damage from the concrete, it is provided according to a further development of the invention that the second anchoring portion comprises load application means for removing the formwork anchor from the concrete, for example suitable through-holes, hexagonal portions or the like.

The formwork anchor can be manufactured in very different manners within the scope of the invention. With regard to a simple and precise manufacturing as well as a high durability of the formwork anchor, it is however provided according to a further development of the invention that the second anchoring portion and the at least sectionally conical portion are formed integrally. It is particularly preferred that the first anchoring portion is connected, in particular tightly connected, to the one-piece unit of the second anchoring portion and the at least sectionally conical section. Thus, it is possible to use common threaded rods or prestressing steel rods as first anchoring portion and to just compress these with the other parts of the formwork anchor in a simple, quick and mechanically reliable manner.

According to a further development of the invention, it is furthermore provided that the formwork anchor is at least sectionally coated, in particular chrome-plated, with the coating being preferably provided in the area of the at least sectionally conical portion. Chrome-plating in particular results in a particularly easy removal of the formwork anchor from the concrete with good durability of the formwork anchor.

DETAILED DESCRIPTION OF PREFERRED EMBODIMENTS

Preferred embodiments of the present invention are discussed in detail below with reference to the corresponding drawings.

Figure 1:
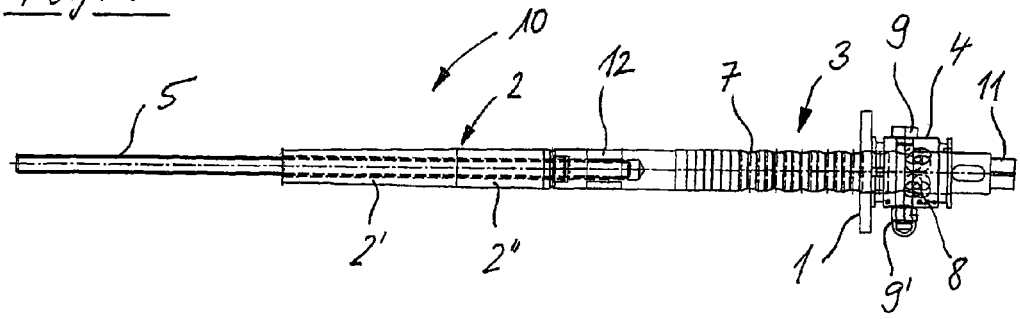
FIG. 1 is a first side view that schematically shows the formwork anchor according to the present invention.
Figure 2:
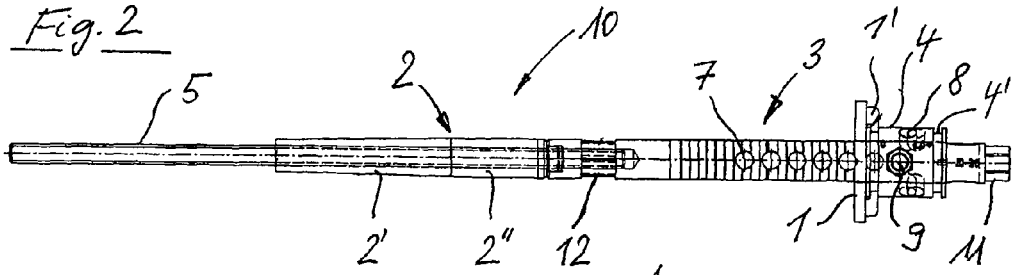
FIG. 2 is a second side view that schematically shows the formwork anchor shown in FIG. 1
Figure 3:
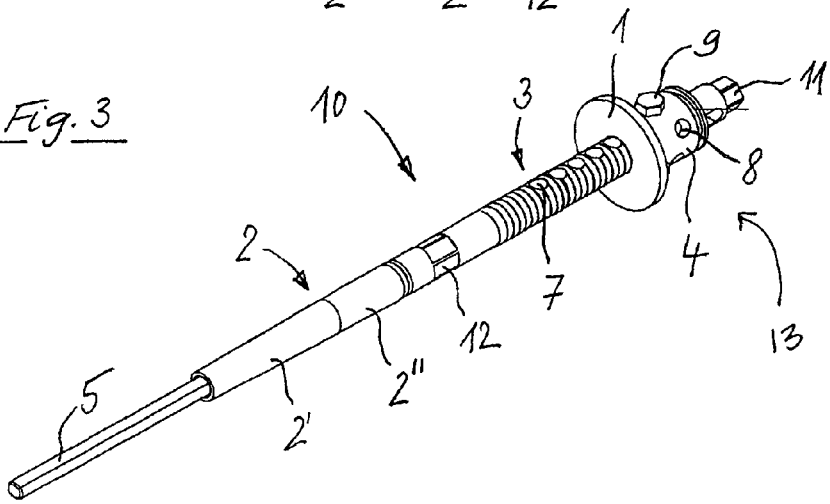
FIG. 3 is a perspective view that schematically shows the formwork anchor shown in FIGS. 1 and 2.

A formwork anchor 10 as the preferred embodiment of the present invention is schematically shown in FIGS. 1 to 3 in two side views and one perspective view. The formwork anchor 10 is used for the tight connection of formwork element, e.g. when manufacturing reinforced concrete walls in which two standing formwork elements are connected with each other in order to achieve a defined wall thickness. The formwork anchor 10 has a first anchoring portion 5 which is formed by a prestressing steel rod in the present embodiment. Such known prestressing steel rods have ribs or a coarse thread by means of which the first anchoring portion 5 can be anchored on a first formwork element by screwing. However, the first anchoring portion 5 can be anchored to the respective formwork element also by other means, e.g. by means of a bayonet mount or the like.

On its opposite side the formwork anchor 10 has a second anchoring portion 3 which will be explained in more detail below. Between the first anchoring portion 5 and the second anchoring portion 3, the formwork anchor 10 in the present embodiment comprises a double conical section 2 having a first conical region 2' and a second conical region 2". The cone aperture angle of the conical region 2" which is located closer to the second anchoring portion 3, is smaller than the aperture angle of the conical region 2'. Furthermore, it must be noted that the conical section 2 can be formed conically only in sections, and can also have a smaller or larger number of conical regions. The surfaces of the conical regions 2' and 2" are chrome-plated in the present embodiment.

Moreover, the at least sectionally conical portion 2 in the present embodiment is formed integrally with the second anchoring portion 3, e.g. as turned component, and the prestressing steel rod 5 is compressed with the unit of conical section 2 and second anchoring portion 3 in the area of a compressed section 12. However, it must be noted that the formwork anchor 10 can also be integrally formed or of a larger number of parts.

The second anchoring portion 3 in the present embodiment is formed as a rod, i.e. without a thread or the like. Instead, the second anchoring portion 3 in the present embodiment has a plurality of through-holes 7 which are spaced in the longitudinal direction of the second anchoring portion 3 (from left to right in FIG. 1) and extend in the present embodiment perpendicularly to the axis of the formwork anchor 10. Moreover, the second anchoring portion has a scale in the form of annular markings which are spaced in the longitudinal direction of the second anchoring portion 3 and enable an exact adjustment of the respective wall thickness.

Finally, the second anchoring portion 3 comprises at its free end (to the right in FIG. 1) load application means in the form of a hexagonal portion such that a socket or fork wrench can be applied here for example in order to remove the formwork anchor 10 from the concrete after concreting.

Furthermore, the formwork anchor 10 according to the invention comprises an anchoring element 13 formed in the present embodiment by a washer disc 1 and a sleeve 4. The washer disc 1 and the sleeve 4 can be slipped onto the second anchoring portion 3 and are freely displaceable in the longitudinal direction thereof, i.e. there is a certain clearance between the inner circumference surfaces of the washer disc 1 and the sleeve 4 and the outer circumference surface of the second anchoring portion 3.

The sleeve 4 in the present embodiment comprises a plurality of through-holes 8 extending in the present embodiment perpendicular to the longitudinal axis of the formwork anchor 10 entirely through the sleeve 4. However, it must be noted that the sleeve 4 can also comprise through-holes which penetrate the sidewall of the sleeve 4 only once. As shown most clearly in FIG. 2, the several through-holes 8 are each arranged thereby in positions offset in the longitudinal direction of the second anchoring portion 3.

By means of the through-hole 7 of the second anchoring portion 3 and the through-holes 8 of the anchoring element 1, 4, the anchoring element 1, 4 can be securely fixed in relation to the second anchoring portion 3. This is carried out in the present embodiment by means of a screw 9 which is led through the through-holes 7, 8 and is secured at its free end with a nut 9', although other means such as bolts or the like could also be used instead of the screw.

Another particularity of the anchoring element 1, 4 is that the washer disc 1 and the sleeve 4 do not necessarily have to be integral, but can also optimally be configured as separate components so that the sleeve 4 is removable from the washer disc 1. After removing the sleeve 4, this can be reconnected with the washer disc 1 either in the same position. Alternatively, it is also possible to turn the sleeve 4 and to connect it at its opposite end to the washer disc 1. For this purpose, as revealed most clearly in FIG. 2, engagement protrusions 1' are provided on the washer disc 1, which can become engaged with grooves 4' provided in the sleeve 4. An even greater variability of the fixing positions of the anchoring element 1, 4 in relation to the second anchoring portion 3 can be achieved by this.

The formwork anchor 10 according to the invention can be used as follows when manufacturing a reinforced concrete wall. Owing to the scale provided on the second anchoring portion 3, the anchoring element 1, 4 can be put in advance in a desired position (and thus wall thickness) in relation to the second anchoring portion 3, with the position of the washer disc 1 at the scale indicating the wall thickness to be manufactured. Thereafter, the screw 9 is led through the openings 7, 8 of the sleeve 4 or the second anchoring portion 3 and is secured, if necessary, at its free end with the nut 9'. The formwork anchor 10 is now led through an opening in a formwork element (not shown) provided for this purpose, and then the thread of the first anchoring portion 5 is entirely screwed into an inner thread provided on an opposite formwork element. In this entirely screwed-in position, the formwork anchor 10 provides a tight connection between the formwork elements such that the desired distance between the formwork surfaces of the formwork elements and thus the desired wall thickness is determined.

The wall can now be concreted, with the at least sectionally conical portion 2 being able to come into direct contact with the concrete. As soon as the concrete has reached a sufficient solidity for forming, the formwork anchor 10 can be removed, for example by applying a suitable tool to the hexagonal 11 and the thread of the first anchoring portion 5 is screwed out of the inner thread of the corresponding formwork element. The formwork anchor 10 can be removed without difficulties owing to the at least sectionally conical configuration of portion 2 which is located in the concrete, and the formwork anchor 10 can be removed entirely.

In this configuration the formwork anchor can be stored or directly used for the next formwork process, with no handling being necessary on the formwork anchor 10 when the wall thickness remains the same, by which the building process is accelerated and error sources minimized.

The invention claimed is:

1. A formwork anchor configured to provide a tight connection of formwork elements by anchoring the formwork elements against one another, the formwork anchor comprising:

a first anchoring portion configured to be anchored on a first formwork element, an at least sectionally conical portion, a second anchoring portion comprising at least one opening, the at least sectionally conical portion being formed integrally with the second anchoring portion, an anchoring element configured to be positioned at the second anchoring portion in an anchoring position, wherein the at least sectionally conical portion is positioned between the first anchoring portion and the second anchoring portion and the anchoring element is freely displaceable in relation to the second anchoring portion in a longitudinal direction thereof and fixable by an engaging device in relation to the second anchoring portion in the longitudinal direction thereof, wherein the first anchoring portion extends partially within the at least sectionally conical portion, and the first anchoring portion is connected to the second anchoring portion and the at least sectionally conical portion by a compressed section provided by compressing the first anchoring portion with the at least sectionally conical portion and second anchoring portion.

2. The formwork anchor according to claim 1, wherein the at least one opening is a through-hole in the second anchoring portion.

3. The formwork anchor according to claim 1, wherein the at least one opening is a through-hole in the anchoring element.

4. The formwork anchor according claim 1, wherein the anchoring element is of multipart design, and at least one part of the anchoring element is detachable from the other part(s) and is reconnectable in a deviating configuration.

5. The formwork anchor according to claim 1, wherein the at least sectionally conical portion comprises several cones.

6. The formwork anchor according to claim 1, wherein the second anchoring portion comprises markings.

7. The formwork anchor according to claim 1, wherein the second anchoring portion comprises load application portion for removing the formwork anchor from concrete.

8. The formwork anchor according to claim 1, wherein the second anchoring portion and the at least sectionally conical portion are formed integrally, and the first anchoring portion is connected therewith.

9. The formwork anchor according to claim 1, wherein the anchor is coated at least sectionally.

10. The formwork anchor according to claim 9, wherein the anchor has a chrome-plated coating.

11. The formwork anchor according to claim 10, wherein the coating is provided in the at least sectionally conical portion region.

12. The formwork anchor according to claim 1, wherein the compressed section is positioned between the at least sectionally conical portion and the second anchoring portion.

13. The formwork anchor according to claim 5, wherein the at least sectionally conical portion includes a cone having a first cone aperture angle and a second cone having a second cone aperture angle, the second cone aperture angle being smaller than the first cone aperture angle.

* * * * *